United States Patent [19]

Kurimoto

[11] Patent Number: 4,621,581

[45] Date of Patent: Nov. 11, 1986

[54] ARTICLE MOVING SYSTEM WITH DRIVE ARMS AND GUIDE CHANNELS

[76] Inventor: Yoshitane Kurimoto, 4-14 Ichikawa Minami 4-chome, Ichikawa-shi, Chiba-ken, Japan

[21] Appl. No.: 707,313

[22] Filed: Mar. 1, 1985

[30] Foreign Application Priority Data

Mar. 2, 1984 [JP] Japan ..... 59-39787

[51] Int. Cl.[4] ..... B60K 7/00; B60P 9/00; B61C 11/00; G05G 11/00

[52] U.S. Cl. ..... 104/140; 104/165; 104/130; 105/29 R; 74/479

[58] Field of Search ..... 104/140, 139, 172 R, 104/173 R, 165, 130; 105/29 R, 29 TL; 74/479

[56] References Cited

U.S. PATENT DOCUMENTS

| | | | |
|---|---|---|---|
| 834,016 | 10/1906 | May | 104/139 X |
| 943,539 | 12/1909 | Harling | 104/173 R X |
| 965,768 | 7/1910 | Van Sant | 104/139 X |
| 1,556,819 | 10/1924 | Hires | 104/173 R |
| 2,631,853 | 6/1950 | Haynes et al. | 104/140 X |
| 3,204,885 | 1/1964 | Van Silfhout | 74/479 X |
| 3,253,552 | 5/1964 | Stein | 105/155 X |
| 3,901,162 | 8/1975 | Bertin | 105/29 R |

FOREIGN PATENT DOCUMENTS

13155/70 12/1965 Japan .

*Primary Examiner*—Robert B. Reeves
*Assistant Examiner*—Scott H. Werny
*Attorney, Agent, or Firm*—Welsh & Katz, Ltd.

[57] ABSTRACT

A small article moving system is disclosed, having an upper plate spaced from a lower plate. The upper and lower plates each have vertically aligned guide channels. An article support rod is inserted into the guide channels at either end and is powered by two pivoting drive arms, each having an elongated slot. The slots intersect at a common opening through which the support rod lies. The arms can be controlled to vary the direction and speed of the rod through the channels.

1 Claim, 9 Drawing Figures

ARTICLE MOVING SYSTEM WITH DRIVE ARMS AND GUIDE CHANNELS

BACKGROUND OF THE INVENTION

This invention relates to a small article moving system designed to move a bar or rod which carries a small article such as a model or an exhibit on the top thereof along a guide channel formed on a surface in advance.

Hitherto, there have been available various types of systems for moving a small article along a guide channel formed on a surface. However, all of them rely upon a simple guide channel, and permit simple movement. Those which can effect such rather complicated functions as start and stop, normal and reverse movement, acceleration and deceleration freely become expensive generally because of the complicated mechanism required for such freedom of movement. Also, they have the general disadvantage that no reliable repeat action or movement can be performed.

SUMMARY OF THE INVENTION

The present invention overcomes the above disadvantage which the prior art systems possessed, and provides for a new freedom of motion and repeatability.

Therefore, it is a general object of the present invention to provide a small article moving system which can freely effect start and stop, normal and reverse movement, acceleration and deceleration of the moving speed of a small article such as a model or an exhibit displayed at, for example, exhibition or fair with ease and at low costs.

In order to achieve the above object and others, there is essentially provided a small article moving system comprising an upper plate; a lower plate provided under said upper plate leaving a predetermined space therebetween, said upper and lower plates each being defined with a guide way of an identical pattern with respect to each other formed in the shape of a guiding groove; a moving rod adapted to carry a small article penetrated into said guide channels defined on the upper and lower plates; and a variable driving means mounted on said moving rod and driven by a reversible motor, said driving means being varied by adequately controlling the rotation of motor.

DETAILED DESCRIPTION OF THE EMBODIMENTS

Preferred embodiments of the present invention will be described hereunder with reference to the accompanying drawings, wherein like numerals denote like or corresponding parts throughout the several sheets.

Figure 1:
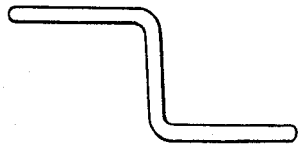
FIG. 1(*a*) through FIG. 1(*l*) are plan views illustrating various orbit patterns of a guide way according to the present invention.
Figure 1:
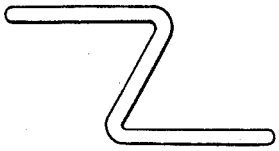
Figure 1:
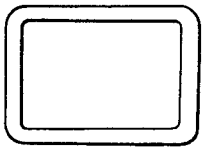
Figure 1:
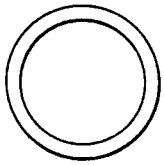
Figure 1:
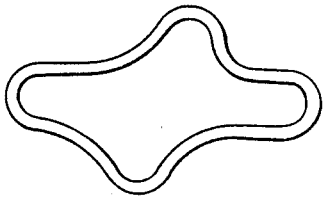
Figure 1:
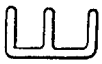
Figure 1:
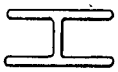
Figure 1:
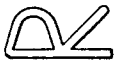
Figure 1:
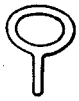
Figure 1:
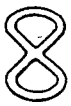
Figure 1:
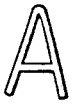
Figure 1:
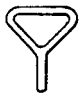
Figure 2:
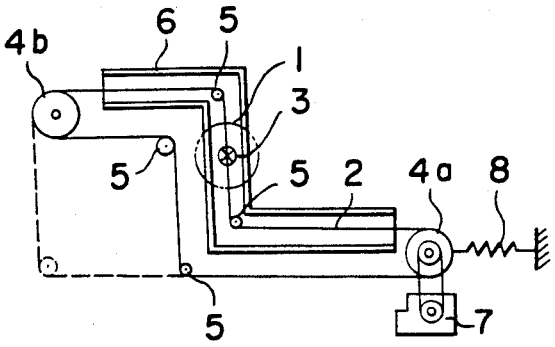
FIG. 2 is a plan view of a small article moving mechanism showing one embodiment of the present invention.
Figure 3:
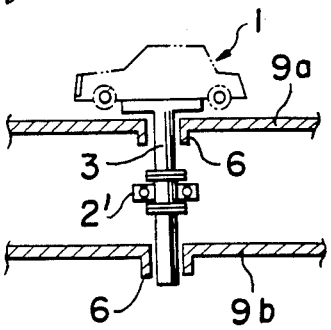
FIG. 3 is a sectional view showing the main portion of FIG. 2.

Referring to FIGS. 2 and 3, a small article 1 is carried by a support rod 3 which is rotatably carried by bearing 2'. A drive means 2 such as a chain, rope, roller chain or silent chain is stretched between a pair of sprockets or gears 4*a*, 4*b* around suitable idlers 5 along a guide path or conduit 6 which may take the shape of any of the patterns set forth in FIG. 1. These patterns are formed on both upper and lower plates. The chain 2 is driven by a motor 7 along the path 6.

Take-up means 8 applies a certain amount of tension to chain 2 while also permitting the absorption of chain expansion as well.

The motor 7 may be driven by a commercial power source or by a battery; therefore it can easily be started and stopped, and may easily reverse rotation. In addition, the rotational speed of the motor 7 can also be controlled for complete control of the speed of movement of the support rod 3. When the gears are used instead of the sprockets, a reduction gear (not shown) may be provided, for better control of the speed of the support rod 3.

Figure 4:
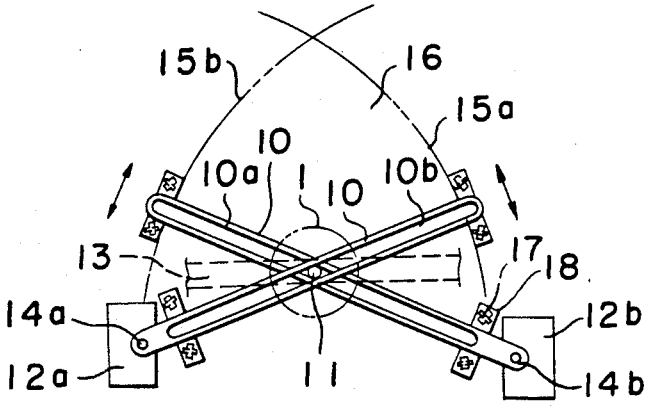
FIG. 4 is a plan view of a small article moving mechanism showing another embodiment of the present invention.

In the embodiments shown in FIGS. 3 and 4, the moving support rod 3 which carries the small article 1 may be square, hexagonal, octagonal or circular in its cross section, as desired, and moves along the guide channel 6 as motivated by the aforementioned mechanism. The guide channel 6 is formed generally in parallel and vertically aligned with one another to provide corresponding orbits or channels in each of an upper surface plate 9*a*, and a lower surface plate 9*b*. Plates 9*a* and 9*b* are vertically, horizontally, or diagonally spaced with respect to each other, so that the moving support rod 3 can smoothly move in between plates 9*a* and 9*b* along with bearing 2', as shown in FIG. 3.

The preferred embodiment of the present invention will be described with reference to FIG. 4. A pair of arms 10, preferbly of the same length and including slots or channels 10*a*, 10*b* extending therethrough, intersect one another, creating a common opening through which rod 11, which carries the small article 1, may be inserted. The pair of arms 10 are kept substantially in parallel with the lower surface plate 9*b*, and are each pivotably supported at one end (14*a*, 14*b*) to a motor and driving apparatus. While one end is driven by motors 12*a*, 12*b* for movement in an arc, the opposite end is normally guided for movement of the small article 1 along a predetermined guide channel 13.

Pivot points 14*a*, 14*b* of the arms 10 are set in a range of positions, so that the moving rod 11, when inserted through the intersection of said guiding grooves 10*a* and 10*b*, can move along the length of the guide channel 13. The start, stop, normal and reverse rotations, acceleration and deceleration of the motors and driving apparatus 12*a*,12*b* are controlled by means of a sequence circuit as known in the art corresponding to the position of the arms on the guide channel 13. Brackets 18 may include universal wheels 17 such as casters, etc. to support the arms 10 so as to provide for oscillation of the arms in a right to left direction on a plane centered about pivot points 14*a* and 14*b*.

By this structure, the guide channel 13 can be applied to any guide ways as long as they are within the range 16 enclosed by arc paths 15*a*, 15*b* on which the pair of arms 10 pivotably moves about pivot points 14*a*, 14*b*.

In the above embodiment, support rod 11 for supporting and transferring the small article 1 is movable along both guide channels on the upper surface plate and lower surface plate, the guide channels being spaced apart with respect to each other and formed in identical patterns with respect to each other.

Figure 5:
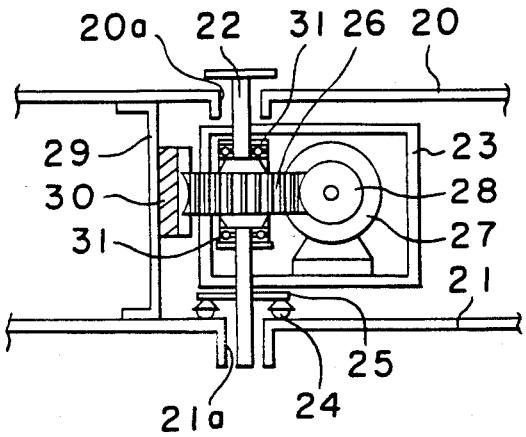
FIG. 5 is a sectional view of a small article moving mechanism showing another embodiment of the present invention.
Figure 6:
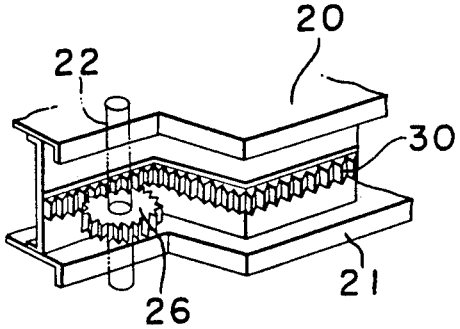
FIG. 6 is a perspective view showing the main portion of FIG. 5.

In the embodiment shown in FIGS. 5 and 6, an upper surface plate 20 and a lower surface plate 21 are formed with guide channels 20*a*, 21*a* with guide grooves in desirable patterns in the corresponding upper and lower positions. The guide channels 20*a*, 21*a* are vertically aligned and formed generally in parallel to provide an orbit on each of an upper surface plate 20, and a lower surface plate 21.

A moving support rod 22 carries a small article thereupon (not shown) through the guide channels 20*a*, 21*a*. A drive means 23 having a motor 27 which drives a worm gear 28 is connected to the moving support rod 22 intermediate upper surface plate 20 and lower surface plate 21. An assembly support plate 25 rests on a plurality of caster wheels 24 to permit the smooth movement of support rod 22 on lower surface plate 21.

The number of said caster wheels 24 utilized depends principally on the size of the articles to be transferred, their weight and the size of the shaft. Also, a supporting member 25 including a plurality of caster wheels 24 for moving the rod smoothly is placed under the box 23 and over the lower surface plate 21.

As shown in FIG. 5, a pinion gear 26 is rotatably secured by bearings 31 to the support rod 22 of the drive means 23 for rotation about the longitudinal axis of the support rod 22. The pinion gear 26 is driven by worm gear 28 fixedly secured to the rotary shaft of motor 27.

Pinion gear 26 is operatively connected for following rotation to rack gear 30 which is situated along the guide channels 20*a*, 21*a*. The rack gear 30 is secured to wall 29 in an upright fashion leaving a predetermined space intermediate guide channels 20*a* and 21*a* to permit movement of the rod 22 along the gear rack 30 according to the rotation of the motor 27. The rack gear 30 is kept substantially in parallel with the lower surface plate 21.

Consequently, the small article (not shown) mounted on the upper end portion of said moving support rod 22 is transferred along the guide channels 20*a* and 21*a* formed in a predetermined pattern and controlled by means of start and stop, normal and reverse rotation, and acceleration and deceleration.

Thus, as described above, the assembly support plate 25 is fixed to the moving support rod 22 and carries a small article mounted on the upper end portion of the moving support rod 22. A smooth movement of the small article through the guide channels 20*a* and 21*a* results from the rack and pinion gear drive in conjunction with the moving support provided by caster wheels 24.

Figure 7:
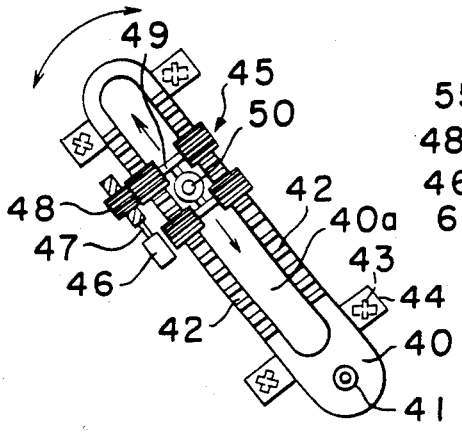
FIG. 7 is a plan view of a small article moving mechanism showing a still another embodiment of the present invention.
Figure 8:
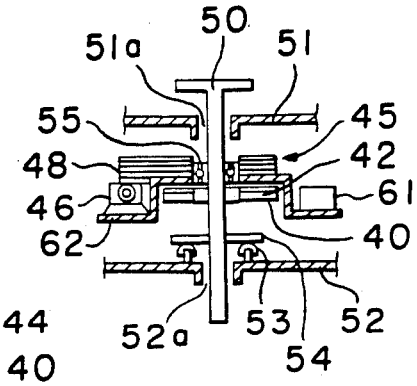
FIG. 8 is a sectional view showing the main portion of FIG. 7.

FIGS. 7 and 8 refer to another embodiment of the present invention wherein oscillating plate 40 is shown. One end of the oscillating plate 40 is supported about pivot point 41 for rotational movement thereabout. The oscillating plate 40 is formed with a longitudinal slot 40*a*. Rack gears 42 with spur gear teeth are integrally formed on opposing side portions of the slot 40*a*.

Both end portions of said oscillating plate 40 have brackets 44 which have caster wheels 43 or the like secured on a bottom portion. Oscillating plate 40 is movable in a horizontal plane about pivot point 41.

The rack gears 42 of the oscillating plate 40 mesh with a pair of spur gears 45, or a spur gears group, respectively, the rotation of which is controlled by means of a worm gear 48 secured to the rotary shaft 47 of motor 46.

Support means 49 for the spur gears 45 carries a moving support rod 50. Furthermore, common base 62 supports counter weight 61 for balancing the entire driving portion placed thereupon.

As shown in FIG. 8, the moving support rod 50 is inserted into the guide channels 51*a* and 52*a* formed in each of the upper surface plate 51 and the lower surface plate 52. The guide channels 51*a* and 52*a* are formed generally in vertical alignment and in parallel as an orbit on each of an upper surface plate 51 and a lower surface plate 52. The moving support rod 50 is moved in a smooth manner by caster wheels 53 fixed to the lower surface of the support plate 54 which, in turn, is secured to the moving support rod 50.

Consequently, the moving support rod 50 may carry a small article on an upper end portion; the motor drives the spur gears group 45 for travel on the upper surface of the oscillating plate 40 in the longitudinal direction, so that the moving support rod 50 travels along guide channels 51*a* and 52*a*. The moving support rod 50 carries a small article thereupon (not shown) through the guide channels 51*a*, 52*a*. A drive means having a motor 46 which drives a rotary shaft 47 and a worm gear 48 is connected to the moving support rod 50 intermediate an upper surface plate 51 and a lower surface plate 52. An assembly support plate 54 rests on a plurality of caster wheels 53 to permit smooth movement of support rod 50 on a lower surface plate 52. Plates 51 and 52 are spaced from one other, so that the moving support rod 50 can smoothly move in channels 51*a* and 52*a* along bearing 55.

As stated, the moving support rod 50 is supported by the spur gears group 45 which move along the guide channels 51*a* and 52*a* while simultaneously moving within longitudinal slot 40*a* defined in the oscillating plate 40. Although the guide channels 51*a* and 52*a* are generally formed within the oscillating range of the oscillating plate 40, the formation of the guide channels 51*a*, 52*a* is such that the longitudinal axis of the oscillating plate 40 is kept with the lower surface plate 52. The positioning of the longitudinal axis of the oscillating plate relative to the guide channel is to be avoided. In the embodiment shown in FIGS. 3, 5 and 8, consequently, the moving support rods 3, 11, 22 and 50 can move along a guide channel of any desired pattern, providing the above restrictions are adhered to.

Figure 9:
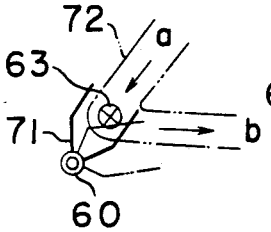
FIG. 9(*a*) through 9(*c*) are various point switches schematically showing the embodiments of the present invention.
Figure 9:
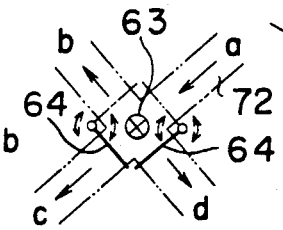
Figure 9:
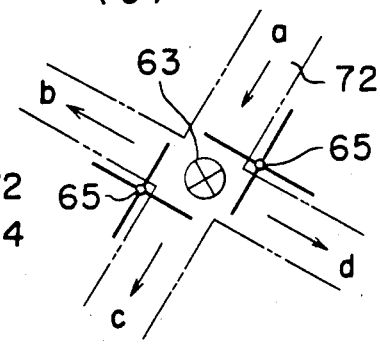

On the other hand, when the moving mechanism as described in the above respective embodiments pass a curved portion or an intersection on a guide way, a point switch is used as shown in FIGS. 9(*a*) through 9(*c*).

In FIG. 9(*a*), when a moving support rod 63 moving along a guide channel 62 in the direction as shown by an arrow "a" is received by a switch device 61 having a pivotal point 60 at a curved portion, the switch device 61 is pivoted by a sensor such as a limit switch to move the moving support rod 63 in the direction as shown by an arrow "b". It is also possible to effect a switchover in the reversed direction.

FIG. 9(*b*) illustrates a switch device at an intersection wherein a pair of switch plates 64 are pivoted by a sensor or the like to cause the moving support rod 63 to move in a desired direction as shown by arrows b, c or d.

FIG. 9(*c*) illustrates another switch device at an intersection, wherein a pair of revolving switch devices 65 are pivoted or revolved by a prefixed sensor or at predetermined time intervals to cause the moving support rod 63 to move in a desired direction as shown by arrows b, c or d.

As described in detail in the foregoing, according to the small article moving system of the present invention, it is possible to control the small article such as a model or an exhibit to start or stop its movement, revolve clockwise or counterclockwise, and accelerate or decelerate freely along a guide channel, all with a simple structure.

Furthermore, the present invention can provide such technical effects as such that various patterns of guide way for moving the small article therealong can be optionally prepared, and that highly reliable repeat actions or movements thereof can be obtained in a simple structure.

While the present invention has been particularly shown and described in its preferred forms with certain degree of particularly, it will be understood by those skilled in the art that the foregoing and other changes may be made without departing from the spirit and the scope of the invention as hereinafter claimed.

What is claimed is:

1. A means for moving articles along a predetermined path at a desired speed comprising;

an article support rod;

a first plate and a second plate, said first plate spaced in a parallel plane from said second plate;

first and second guide channels formed in a desired configuration in said first and second plates respectively;

said first guide channel configuration being vertically aligned with said second channel configuration;

said article support rod being positioned in each of said first and second guide channels in a plane perpendicular to said plates and moved by drive means along said guide channels;

said drive means comprising first and second drive arms, said first and second drive arms each having an elongated slot, and each being pivotally secured at one end thereof and driven by motor means for movement in intersecting arcs, said arms thereby intersecting to form a common opening therebetween; said article support rod being inserted in said common opening, whereby movement of said first and second drive arms in their respective arcs drive said article support rod in said guide channels;

switch means located at desired locations along said channels for effecting a change of direction of said article support rod within said guide channels; and said article support rod being mounted on a caster wheel assembly for support thereof while maintaining ease of movement.

* * * * *